United States Patent [19]

Arai et al.

[11] Patent Number: 4,734,131

[45] Date of Patent: Mar. 29, 1988

[54] PERMANENT-MAGNETIC MATERIAL

[75] Inventors: Tomohisa Arai; Naoyuki Sori; Seiki Sato; Nobuo Uchida, all of Yokohama, Japan

[73] Assignee: Kabushiki Kaisha Toshiba, Kawasaki, Japan

[21] Appl. No.: 75,996

[22] Filed: Jul. 21, 1987

[30] Foreign Application Priority Data

Jul. 23, 1986 [JP] Japan ..... 61-173200

[51] Int. Cl.[4] ..... C22C 29/14

[52] U.S. Cl. ..... 75/244; 148/102; 148/103; 148/108; 252/62.55; 419/12; 419/26; 419/29; 419/32; 419/33

[58] Field of Search ..... 479/12, 32, 33, 26, 479/29; 75/244; 252/62.55; 148/102, 103, 108

[56] References Cited

U.S. PATENT DOCUMENTS

| | | | |
|---|---|---|---|
| 3,874,938 | 4/1975 | Benjamin et al. | 419/29 |
| 4,030,946 | 6/1977 | Muzyka | 75/246 |
| 4,104,787 | 8/1978 | Jandeska et al. | 419/8 |
| 4,585,473 | 4/1986 | Narasimhan | 75/246 |
| 4,601,875 | 7/1986 | Yamamoto et al. | 419/29 |
| 4,678,634 | 7/1987 | Tawara et al. | 419/38 |

FOREIGN PATENT DOCUMENTS 56-47540 4/1981 Japan .

*Primary Examiner*—Stephen J. Lechert, Jr.

*Attorney, Agent, or Firm*—Finnegan, Henderson, Farabow, Garrett & Dunner

[57] ABSTRACT

A permanent-magnet material having a composition represented by the following formula;

$$R(Co_{1-X-Y-\alpha-\beta}Fe_XCu_YM_\alpha M'_{62})A$$

(wherein X, Y, $\alpha$, $\beta$, and A respectively represent the following numbers:

$$0.01 \leqq X,\ 0.02 \leqq Y \leqq 0.25,\ 0.001 \leqq \alpha \leqq 0.15,$$

$$0.0001 \leqq \beta \leqq 0.001, \text{ and } 6.0 \leqq A \leqq 8.3,$$

providing that the amount of Fe to be added should be less than 15% by weight, based on the total amount of the composition, and R, M, and M' respectively represent the following constituents:

R: At least one element selected from the group of rare earth elements,

M: At least one element selected from the group consisting of Ti, Zr, Hf, Nb, V, and Ta, and M': B or B+Si), is disclosed. The permanent-magnetic material of the present invention is consisting of an intermetallic compound, permitting coexistence of liquid and solid phases in a wide region, and enabling sintering conditions warranting impartation of highly desirable magnetic characteristics to be selected in wide ranges.

9 Claims, 1 Drawing Figure

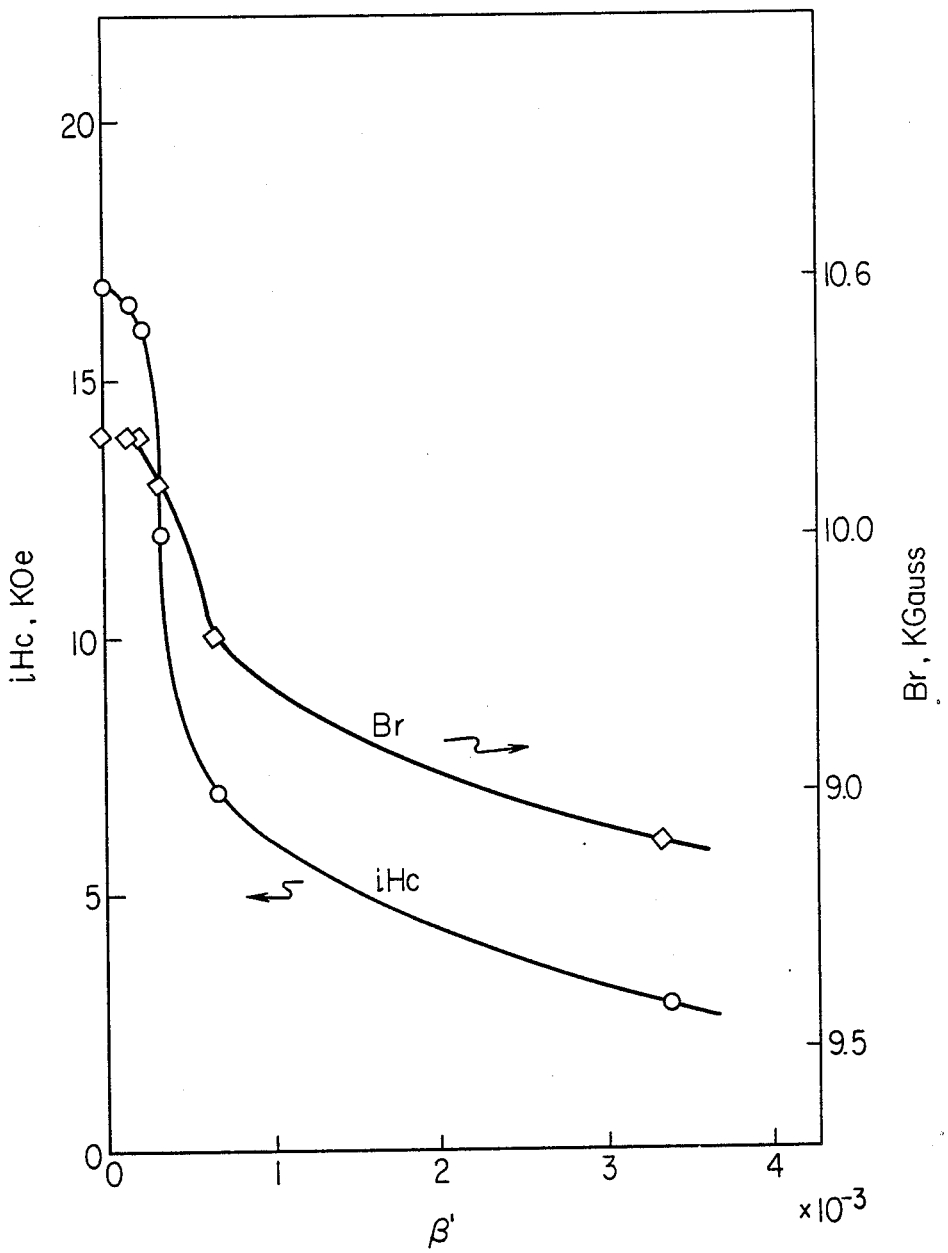
20
15
10
5
0
iHc, KOe
10.6
10.0
9.0
9.5
Br, KGauss
Br
iHc
0
1
2
3
4
β'
x10⁻³

PERMANENT-MAGNETIC MATERIAL

The present application claims priority of Japanese Patent Application No. 61-173,200 filed on July 23, 1986.

FIELD OF THE INVENTION AND RELATED ART STATEMENT

This invention relates to an intermetallic compound type permanent-magnet material comprising a rare earth element and Co, and particularly to an intermetallic compound type permanent-magnet material comprising a rare earth element and Co and possessing an improved sintering property and to a method for the production thereof.

Heretofore, the intermetallic compound type alloys which are formed by combining a rare earth element combination of Sm and Ce with Co and Fe, Cu, etc. have been known as permanent-magnet materials excelling in residual flux density and coercive force.

The intermetallic compound type alloys which incorporate therein B and Ti, V, Zr, etc. besides the elements mentioned above for the purpose of acquiring further improved coercive force have also been known (specification of Japanese Patent Application Disclosure No. SHO 55(1980)-115,304).

Japanese Patent Application Disclosure No. SHO 56(1981)47,540 discloses a permanent-magnet material produced by the combination of Zr and at least one element selected from among Ca, S, P, Mg, and B.

These permanent-magnet materials, however, have the disadvantage that their regions permitting coexistence of liquid and solid phases are narrow and their sintering conditions permitting impartation of highly desirable magnetic characteristics are restricted to extremely narrow ranges as represented by the temperature range of ±1° C. to 2° C.

If a permanent-magnet material which has sintering conditions permitting impartation of highly satisfactory magnetic characteristics in such a narrow range as mentioned above is produced with an industrial grade furnace of popular use, since this furnace has a large inner temperature gradient, the produced permanent-magnet material is liable to acquire inferior characteristics and the production itself suffers from a poor yield.

The inventors continued a study in an effort to eliminate the drawbacks suffered by the conventional permanent-magnet materials as described above. They have consequently found that the permanent-magnet materials formed of intermetallic type compound alloys of the elass under discussion are enabled by addition thereto of a minute amount of B to permit coexistence of solid and liquid phases in widened regions and acquire notable improvement in their sintering property.

OBJECT AND SUMMARY OF THE INVENTION

The present invention, having originated in the finding mentioned above, aims to provide a permanent-magnet material which permits coexistence of liquid and solid phases in a wide region and enables sintering conditions warranting impartation of highly desirable magnetic characteristics to be selected in wide ranges.

Specifically, the permanent-magnet materials of the present invention has a composition represented by the following formula:

$$R(Co_{1-X-Y-\alpha-\beta}Fe_XCu_YM_\alpha M'_\beta)_A$$

(wherein X, Y, $\alpha$, $\beta$, and A respectively represent the following numbers:

$$0.01 \leqq X,\ 0.02 \leqq Y \leqq 0.25,\ 0.001 \leqq \alpha \leqq 0.15,$$

$$0.0001 \leqq \beta \leqq 0.001, \text{ and } 6.0 \leqq A \leqq 8.3,$$

providing that the amount of Fe to be added should be less than 15% by weight, based on the total amount of the composition, and R, M, and M' respectively represent the following constituents:

R: At least one element selected from the group of rare earth elements,

M: At least one element selected from the group consisting of Ti, Zr, Hf, Nb, V, and Ta, and M': B or B+Si)

and is enabled, by effective selection of the amount of B or B+Si to be incorporated therein as the constituent M', to acquire highly desirable magnetic characteristics and permit sintering conditons to be selected in wide ranges.

BRIEF DESCRIPTION OF THE DRAWING

The characteristics of this invention are discerned clearly from a figure. To be more specific, the figure is a graph showing curves of residual flux density, Br, and coercive force, "iHc", as the functions of the amount of boron, B, $\beta$, obtained of test specimens of a composition, $Sm(Co_{0.70-\beta}Fe_{0.20}Cu_{0.07}Zr_{0.03}B_\beta)_{7.8}$.

DETAILED DESCRIPTION OF THE INVENTION

In the present invention, the numerical values of X, Y, $\alpha$, $\beta$, and A in the formula of composition are defined as mentioned above for the following reason.

$$0.01 \leqq X; \quad (1)$$

An increase in the amount of Fe is found to bring about an improvement in residual flux density. If the amount of Fe to be added increases to exceed 15% by weight, based on the total amount of composition, the mixture of component raw materials is finely comminuted only with great difficulty. If X is less than 0.01 ($X<0.01$), no sufficiently high residual flux density is obtained.

$$0.02 \leqq Y \leqq 0.25; \quad (2)$$

If the relative amount of copper, Y, is less than 0.02 ($0.02>Y$), the reaction of two-phase decomposition proceeds with difficulty.

If this amount is more than 0.25 ($0.25<Y$), the residual flux density is unduly low and the thermal stability is insufficient.

$$0.001 \leqq \alpha \leqq 0.15; \quad (3)$$

The constituent M is at least one element to be selected from among Ti, Zr, Hf, Nb, V, and Ta, preferably from among Ti, Zr, and Hf. If is less than 0.001 ($0.001>\alpha$), no sufficient coercive force is obtained. If $\alpha$ is more than 0.15 ($0.15<\alpha$), the residual flux density is not sufficient.

$$0.0001 \leqq \beta \leqq 0.001; \quad (4)$$

The constituent M' is either B or B+Si. Particularly, the amount of boron, B, to be incorporated has a conspicuous effect on the magnetic characteristics of a magnet to be produced. The figure shows the curves of residual flux density, Br, and coercive force, "iHc", as the functions of the amount of B, $\beta$, obtained of test specimens having a typical composition, $$Sm(Co_{0.70-\beta}Fe_{0.20}Cu_{0.07}Zr_{0.03}B_{\beta})_{7.8}.$$

It is noted from the figure that both Br and iHc are varied very largely by a minute change in the amount of boron, B and that they both decrease with the increasing amount of B. Particularly, both Br and "iHc" sharply decrease when the numerical value of $\beta$ increases beyond $1\times10^{-3}$.

It has been established experimentally, on the other hand, that the effect in the improvement of sintering property suddenly cease to exist when the relative amount of B to be added decreases below $1\times10^{-4}$.

$$6.0\leqq A\leqq 8.3 \quad (5)$$

If A is less than 6.0 (6.0>A), no sufficient coercive force Br is obtained. If A is more than 8.3 (8.3<A), the composition gives rise to dendrite, an undesirable ingredient for the permanent magnet aimed at.

The permanent magnet of this invention is produced by preparing metallic elements, i.e. component raw materials, in the proportions indicated by the aforementioned formula, melting and casting the raw materials in an inert atmosphere thereby producing an ingot, coarsely crushing this ingot into coarse particles, then finely comminuting the coarse particles into fine particles not more than 10 μm in diameter, orienting a mass of the finely comminuted mixturfe in a magnetic field, forming the oriented mass of mixture as compressed thereby giving rise to a shaped article, sintering the shaped article in an inert atmosphere at a temperature in the range of 1,180° C. to 1,230° C. for a period in the range of 3 to 6 hours, further subjecting the sintered shaped article to a solution treatment at a temperature in the range of 1,150° C. to 1,210° C. for a period in the range of 3 to 12 hours, subsequently allowing the resultant shaped article to stand at a temperature in the range of 700° C. to 900° C. for a period in the range of 4 to 12 hours, and left aging in a furnace under controlled cooling.

The permanent magnet according to the present invention is such that it acquires highly desirable magnetic characteristics even when the shaped article, in the aforementioned step of sintering, is sintered at a temperature 10° C. to 20° C. lower than "the temperature of loss by melting" (the temperature at which the article can not retain required shape because the amount of liquid phase thereof becomes more than certain level in the sintering step). Thus, even in a furnace such as the industrial grade furnace which has a relatively wide range of temperature control, the permanent magnet can be produced with well balanced characteristics.

Further, the permanent-magnet material of the present invention can be produced by mixing a powdered alloy having a composition of the formula:

$$R(Co_{1-X-Y-\alpha}Fe_{X}Cu_{Y}M_{\alpha})_{A} \quad (I)$$

and a powdered alloy having a composition of the formula:

$$R(Co_{1-X-Y-\alpha-\beta}Fe_{X}Cu_{Y}M_{\alpha}M'_{\beta})_{A} \quad (II)$$

in a prescribed ratio, forming the resultant mixture in a magnetic field in a stated shape, and then heat treating the resultant shaped article at a temperature not exceeding the melting point.

Suitably the mixing ratio of the powdered alloy represented by the formula (I) and the powdered alloy represented by the formula (II) falls in the range of 1:1 to 1,000:1.

Entirely the same effect as described above is obtained when boron, B is added in a prescribed proportion during the melting of the other component raw materials instead of simultaneously mixing all the component raw materials.

In the permanent-magnet material of the present invention, the element B which is incorporated in a very minute amount functions to lower notably the melting point of the grain boundaries and the element B so incorporated undergoes solid solution with the mother phase only to a nominal extent and, therefore, segregates itself in the grain boundaries and brings about a minimal effect on the magnetic characteristics of the permanent magnet.

Now, the present invention will be descried specifically below with reference to working examples.

EXAMPLE 1

Pertinent raw materials in a molten state were combined in proportions calculated to give a composition of the following formula:

$$(Sm_{0.6}Co_{0.4})(Co_{0.72-0.0008}Fe_{0.2-0}Cu_{0.06}Zr_{0.02}B_{0.00018})_{7.45}$$

The resultant mixture was melted and cast in a high-frequency furnace, then coarsely crushed with a jaw crusher, and further comminuted finely with a jet mill to obtain a powdered mixture having particle diameters of 3 to 10 μm. This powdered mixture was press formed in a magnetic field of 10 KOe under a pressure of 2 tons/cm$^2$ to obtain a rectangular slid measuring 40 mm×40 mm×10 mm. This shaped article was sintered in an industrial grade furnace at a temperature in the range of 1,150° C. to 1,180° C. for a period in the range of 3 to 6 hours, surther subjected to a solution treatment at a temperature in the range of 1,120° C. to 1,150° C. for a period in the range of 3 to 12 hours, subsequently left aging at a temperature in the range of 700° C. to 900° C. for a period in the range of 4 to 12 hours, and thereafter cooled as controlled in a furnace. Thus, a permanent-magnet material was obtained as aimed at.

Separately, for comparison, a permanent-magnet material was produced by faithfully following the procedure of Example 1, excepting the molten material composed of the aforementioned components excluded B. In this case, the permanent-magnet material was allowed to acquire the expected characteristics only when the work of sintering was carried out at a temperature 2° C. lower than the temperature of loss by melting, with the temperature controlled rigidly accurately within ±1° C. When the work of sintering was carried out in an industrial grade furnace, the magnetic characteristics of the product were heavily dispersed by relative position of sintering. The magnetic characteristics of the product of Example 1 and those of the product of the comparative experiment are shown in the Table.

TABLE

| Sintering temperature (relative to temperature of loss by melting) | Example 1 Product incorporating B ($\beta$ = 0.00018) | | | Comparative Experiment Product incorporating no B | | |
|---|---|---|---|---|---|---|
| | Br (gauss) | (BH) max (MGOe) | iHc (Oe) | Br (gauss) | (BH) max (MGOe) | iHc (Oe) |
| −2° C. | 9,900 | 23.8 | 10,800 | 9,900 | 24.1 | 11,400 |
| −5° C. | 9,900 | 24.1 | 11,500 | 9,800 | 23.2 | 13,600 |
| −10° C. | 9,900 | 25.0 | 13,000 | 9,100 | 20.7 | 13,600 |
| −20° C. | 9,850 | 24.3 | 13,500 | 8,300 | 14.2 | 10,200 |
| −30° C. | 9,800 | 23.9 | 13,500 | 7,500 | 10.5 | 9,800 |

EXAMPLE 2

A powdered alloy of a composition:

$$(Sm_{0.60}Ce_{0.40})(Co_{0.72}Fe_{0.20}Cu_{0.06}Zr_{0.02})_{7.45} \quad (I')$$

having particle diameters of 3 to 10 μm and prepared by following the procedure of Example 1 and a powdered alloy of a composition:

$$(Sm_{0.60}Ce_{0.40})(Co_{0.72-0.072}Fe_{0.20}Cu_{0.06}Zr_{0.02}B_{0.072})_{7.45} \quad (II')$$

were mixed in a ratio of 400:1. The resultant powdered mixture was formed under the same conditions. The resultant shaped article was sintered and subjected to a solution treatment and left aging in an industrial grade furnace under the same conditions as in Example 1.

The permanent-magnet material consequently obtained acquired highly desirable magnetic characteristics even when the shaped article, during the step of sintering, was sintered in a temperature range 10° C. to 40° C. lower than the temperature of loss by melting. These magnetic characteristics were equivalent to those obtained when there was used a single powdered alloy of a composition contemplated by the invention.

EXAMPLE 3

A powdered alloy of a composition:

$$Sm(Co_{0.71}Fe_{0.14}Cu_{0.13}Ti_{0.02})_{6.99} \quad (I'')$$

having particle diameters of 3 to 10 μm and prepared by following the procedure of Example 1 and a powdered alloy of a composition:

$$Sm(Co_{0.71-0.072}Fe_{0.14}Cu_{0.13}Ti_{0.02}B_{0.072})_{6.99} \quad (II'')$$

were mixed at a ratio of 400:1. The resultant powdered mixture was formed under the same conditions as in Example 1, sintered in an industrial grade furnace at a temperature in the range of 1,170° C. to 1,190° C., then subjected to a solution treatment at a temperature in the range of 1,150° C. to 1,170° C., subsequently left cooling at a temperature in the range of 500° C. to 600° C., and subjected to an aging treatment.

The permanent-magnet material consequently obtained acquired highly desirable magnetic characteristics even when the shaped article, during the step of sintering, was sintered in a temperature zone 0° C. to 20° C. lower than the proper sintering temperature of the alloy of the composition (I'') containing no boron, B. The magnetic characteristics were equivalent to those obtained when there was used a single powdered alloy of a composition contemplated by this invention.

The foregoing working examples have been described as representing cases using B as the constituent M'. This invention is not limited to those working examples. The same effect as described above can be obtained in cases using B+Si in the place of B. Further, the same effect can be obtained also in cases using elements other than those indicated in the foregoing working examples as the constituent M.

The permanent-magnet material of the present invention is enabled, by addition thereto of a minute amounbt of B, to acquire a conspicuously improved sintering property and enjoy notable improvements in productivity and yield with respect to the sintering performed in an industrial grade furnace.

What is claimed is:

1. A permanent-magnet material having a composition represented by the following formula;

$$R(Co_{1-X-Y-\alpha-\beta}Fe_XCu_YM_\alpha M'_\beta)_A$$

(wherein X, Y, $\alpha$, $\beta$, and A respectively represent the following numbers:

$$0.01 \leqq X,\ 0.02 \leqq Y \leqq 0.25,\ 0.001 \leqq \alpha \leqq 0.15,$$

$$0.0001 \leqq \beta \leqq 0.001, \text{ and } 6.0 \leqq A \leqq 8.3,$$

providing that the amount of Fe to be added should be less than 15% by weight, based on the total amount of the composition, and R, M, and M' respectively represent the following constituents:

R: At last one element selected from the group of rare earth elements,

M: At least one element selected from the group consisting of Ti, Zr, Hf, Nb, V, and Ta, and M': B or B+Si).

2. The permanent-magnet material according to claim 1, wherein the amount of the constituent, Sm and/or Ce, is not less than 80% by weight, based on the total amount of the constituent, R.

3. The permanent-magnet material according to claim 1, wherein the constituent M is at least one element selected from among Ti, Zr, and Hf.

4. A method for the production of a permanent-magnet material, characterized by combining pertinent metallic elements as component raw materials in proportions indicated by the following formula:

$$R(Co_{1-X-Y-\alpha-\beta}Fe_XCu_YM_\alpha M'_\beta)_A$$

(wherein X, Y, $\alpha$, $\beta$, and A respectively represent the following numbers:

$$0.01 \leqq X,\ 0.02 \leqq Y \leqq 0.25,\ 0.001 \leqq a \leqq 0.15,$$

$0.0001 \leqq \beta \leqq 0.001$, and $6.0 \leqq A \leqq 8.3$, providing that the amount of Fe to be added should be less than 15% by weight, based on the total amount of the composition, and R, M, and M' respectively represent the following constituents:

R: At last one element selected from the group of rare earth elements,

M: At least one element selected from the group consisting of Ti, Zr, Hf, Nb, V, and Ta, and M': B or B+Si), melting and casting the resultant mixture in an inert atmosphere thereby obtaining an ingot, coarsely crushing said ingot into coarse particles, finely comminuting said coarse particles into fine particles having particle diameters of not more than 10 μm, orienting a mass of said finely comminuted mixture in a magnetic field, then forming said mass of mixture as compressed thereby obtaining a shaped article, sintering said shaped article in an inert atmosphere at a temperature in the range of 1,150° C. to 1,230° C. for a period in the range of 3 to 6 hours, subjecting the sintered shaped article to a solution treatment at a temperature in the range of 1,120° C. to 1,210° C. for a period in the range of 3 to 12 hours subsequently keeping the resultant shaped article at a temperature in the range of 750° C. to 850° C. for a period in the range of 4 to 12 hours, and thereafter aging the shaped article by cooling.

5. The method according to claim 4, wherein the amount of the constituent, Sm and/or Ce, is not less than 80% by weight, based on the total amount of the constituent, R.

6. The method according to claim 4, wherein the constituent M is at least one element selected from among Ti, Zr, and Hf.

7. A method for the production of a permanent-magnet material, comprising the steps of mixing a powdered alloy of a composition represented by the formula:

$$R(Co_{1-X-Y-\alpha}Fe_XCu_YM_\alpha)_A$$

and a powdered alloy of a composition represented by the formula:

$$R(Co_{1-X-Y-\alpha-\beta},Fe_XCu_YM_\alpha M'_\beta)_A$$

in a ratio falling in the range of 1:1 to 1,000:1, thereby producing a mixture of a composition represented by the formula:

$$R(Co_{1-X-Y-\alpha-\beta}Fe_XCu_YM_\alpha M'_\beta)_A$$

(wherein, X, Y, α, β, and A respectively represent the following numbers:

$0.01 \leqq X$, $0.02 \leqq Y \leqq 0.25$, $0.001 \leqq \alpha \leqq 0.15$, $0.0001 \leqq \beta \leqq 0.001$, $6.0 \leqq A \leqq 8.3$, and $2\beta \leqq \beta'$, providing that th amount of Fe to be added should be less than 15% by weight, based on the total amount of the composition, and R, M, and M' respectively represent the following constituents:

R: At least one element selected from the group of rare earth elements,

M: At least one element selected from the group consisting of Ti, Zr, Hf, Nb, V, and Ta, and M': B or B+Si), forming said mixture in a magnetic field under pressure thereby obtaining a shaped article, and sintering said shaped article at a temperature 0° C. to 40° C. lower than the temperature of loss by melting (the temperature at which the article can not retain required shape because the amount of liquid phase thereof becomes more than certain level in the sintering step).

8. The method according to claim 7, wherein the amount of the constituent, Sm and/or Ce, is not less than 80% by weight, based on the total amount of the constituent, R.

9. The method according to claim 7, wherein the constituent M is at least one element selected from among Ti, Zr, and Hf.

* * * * *